US005651912A

United States Patent [19]

Mitsumoto et al.

[11] Patent Number: 5,651,912

[45] Date of Patent: Jul. 29, 1997

[54] DECORATIVE MOLD FOR FORMING CONCRETE SURFACE WITH UNEVEN PATTERN

[75] Inventors: Masanori Mitsumoto, Tokyo; Hideki Kuwabara, Utsunomiya; Kazuhiko Omori, Utsunomiya; Satoru Shioya, Utsunomiya; Wataru Kikuchi, Kanuma, all of Japan

[73] Assignee: JSP Corporation, Tokyo, Japan

[21] Appl. No.: 530,426

[22] Filed: Sep. 19, 1995

[30] Foreign Application Priority Data

Sep. 20, 1994 [JP] Japan ..... 6-251498

[51] Int. Cl.[6] ..... B28B 7/34

[52] U.S. Cl. ..... 249/134; 249/117

[58] Field of Search ..... 249/117, 119, 249/134

[56] References Cited

U.S. PATENT DOCUMENTS

| | | | |
|---|---|---|---|
| 2,981,997 | 5/1961 | Painter | 249/134 |
| 4,842,241 | 6/1989 | Fitzgerald et al. | 249/50 |
| 4,919,388 | 4/1990 | Koike et al. | 249/134 |
| 5,386,963 | 2/1995 | Nasvik et al. | 249/134 |

*Primary Examiner*—Thomas R. Weber
*Attorney, Agent, or Firm*—Sherman and Shalloway

[57] ABSTRACT

The present invention relates to a decorative mold having an uneven pattern for forming a concrete surface with an uneven pattern by transfer. The present decorative mold is made of a molded product of polypropylene type foamed particles having a density of 0.02 to 0.06 g/cm$^3$ and is formed with an uneven pattern on one surface for forming a pattern on a concrete surface by transfer, and in the surface having the uneven pattern for transfer, the total area, in terms of projected plane, of gap sections present in all the projected plane of the decorative mold accounts for less than 0.5% of all the area, in terms of projected plane, of the decorative mold. The maximum bending strength of the decorative mold determined by pressing from the undersurface opposite to the side having the uneven pattern is preferably 8.0 kgf/cm$^2$ or more, and the average particle diameter of the polypropylene type resin foamed particles that are a raw material constituting the decorative mold is preferably 1 to 4 mm. The side walls are preferably spread out from the undersurface side of the decorative mold toward the side of the surface having the uneven pattern. Further the molded product of polypropylene type resin foamed particles that constitutes the decorative mold has preferably such a crystalline structure that the DSC curve obtained by subjecting the molded product to differential scanning calorimetry has a high-temperature peak the amount of heat of which is 13 to 30 J/g.

10 Claims, 4 Drawing Sheets

DECORATIVE MOLD FOR FORMING CONCRETE SURFACE WITH UNEVEN PATTERN

BACKGROUND OF THE INVENTION

1. Field of the Invention

The present invention relates to a decorative mold for forming a concrete surface with an uneven pattern.

2. Description of the Background Art

For the construction work, for example, of river-protection, preparation of residences, improvement of slopes, reform of roads, and retaining walls, the concrete placement technique is employed which is advantageous in all of durability, material cost, execution, and the like. However, the concrete surface formed simply by placing concrete in a concrete placement form is monotonous and is difficult to exhibit a beautiful view in harmony with the region where there are houses, mountains, and the like. Accordingly, in recent years, a demand for the formation of concrete surfaces provided with an artistic design is increased.

As an execution method that can answer such a demand, a methods is suggested wherein a decorative mold made of a foamed material which is formed with an uneven pattern, such as a masonry pattern and a brickwork pattern is attached to a concrete placement form and then concrete is placed in the concrete placement form, so that the uneven pattern of the decorative mold is transferred onto the resulting concrete surface (e.g., Japanese Patent Application Laid-Open No. 107510/1988 and Japanese Utility Model Publication No. 24483/1984).

In the above prior method, as the decorative mold with an uneven pattern on the surface, a molded product of polystyrene type resin foamed particles is used because it is relatively inexpensive, etc.

However, there are problems, that is, for example, since a decorative mold of polystyrene type resin foamed particles is liable to adhere strongly to concrete, it becomes difficult to separate the decorative mold from the surface of the placed concrete, and since a mold of polystyrene type resin foamed particles is relatively low in material strength (i.e., relatively brittle) and poor in flexibility, when the mold is separated from the concrete surface, part of the mold is broken and remains adhered to the concrete surface. Accordingly, that leads to a problem that the execution is laborious because the remnant on the concrete surface after the removal of the mold must be removed by scraping or burning by a burner. Further since the prior decorative mold of polystyrene type resin foamed particles is liable to be broken when it is removed from the concrete surface, the mold cannot withstand to be used repeatedly.

On the other hand, Japanese Utility Model Application Laid-Open No. 129258/1992 describes that when a decorative mold is made of a foamed polypropylene or a foamed poly(ethylene/propylene) copolymer, the releasability of the decorative mold from the concrete surface and the durability of the decorative mold can be improved. However, if a decorative mold comprises simply a molded product of polypropylene type resin foamed particles, there is a problem that, for example, when the decorative mold is bent so that the decorative mold may be removed from the concrete surface, the transfer patterned surface of the mold is cracked and therefore it becomes difficult to use the mold again. Further, the molded product of foamed particles is obtained by filling a mold with foamed particles and heating the mold to cause the particles to be fused together and therefore the thus obtained mold has spaces called voids between the foamed and fused particles. To obtain a strength required for the decorative mold, although it is necessary to use foamed particles relatively low in expansion ratio, the molded product obtained by using foamed particles low in expansion ratio is apt to be formed with a number of large voids in the surface, so that there are such problems that the marks of these voids also are transferred to the concrete surface to degrade the appearance and the concrete comes into the voids to lower the releasability of the mold.

Further, sometimes the uneven patterned surface of the decorative mold is coated with a coating material for the purpose of coloring the concrete surface, and if there are a number of large voids in the uneven patterned surface of the decorative mold, a problem surfaces that the coating material comes into the voids and the coating material is difficult to be transferred onto the concrete surface.

SUMMARY OF THE INVENTION

The present invention has been made taking the above problems into consideration, and an object of the present invention is to provide a decorative mold that is excellent, for example, in durability, releasability from the concrete surface, releasability from a coating material, and transferability of the uneven pattern onto the concrete surface.

That is, the present decorative mold for forming a concrete surface with an uneven pattern is a decorative mold for forming an uneven pattern on a concrete surface by transfer, which decorative mold comprises a molded product of polypropylene type resin foamed particles that has a density of 0.02 to 0.06 g/cm$^3$ and possesses on one surface an uneven pattern for forming an uneven pattern on a concrete surface by transfer, wherein, in the surface having the uneven pattern for transfer, the total area, in terms of projected plane, of gap sections present in all the projected plane of the decorative mold accounts for less than 0.5% of all the area, in terms of projected plane, of the decorative mold.

Preferably, in the present decorative mold, the maximum bending strength of the decorative mold determined by pressing from the undersurface opposite to the side having the uneven pattern in accordance with JIS K7221 is 8.0 kgf/cm$^2$ or more, and the side walls are spread out from the undersurface side of the decorative mold toward the side of the surface having the uneven pattern. Preferably, in the present decorative mold, the average particle diameter of the polypropylene type resin foamed particles that are a raw material constituting the decorative mold is 1 to 4 mm. Further, preferably, in the present decorative mold, the molded product of polypropylene type resin foamed particles that constitutes the decorative mold has such a crystalline structure that the DSC curve obtained by subjecting the molded product to differential scanning calorimetry has, in addition to the inherent peak corresponding to the absorption of heat at the time of melting of the polypropylene type resin, a high-temperature peak the amount of heat of which is 13 to 30 J/g on the side where the temperature is higher than that of said inherent peak.

Since the present decorative mold comprises a molded mold of polypropylene type resin foamed particles that has a density of 0.02 to 0.06 g/cm$^3$ and, the total area, in terms of projected plane, of the gap sections in the surface having an uneven pattern accounts for less than 0.5% of all the area of the projected plane, the present decorative mold is excellent in releasability from the surface of placed concrete and can form a beautiful uneven pattern on a concrete surface by transfer with high transferability.

Further, in the case wherein a coating material is applied previously on the surface having the uneven pattern of the decorative mold for the purpose of coloring the concrete surface, since the present decorative mold is excellent in that the decorative mold allows the coating material to be released, the coating material can be transferred to the concrete surface positively.

Since the present decorative mold is excellent in releasability and bending strength, even when the decorative mold is released while the decorative mold is being bent, the decorative mold is not damaged, the releasing work of the decorative mold becomes very easy, and the decorative mold can be used again.

When the present decorative mold has a maximum bending strength of 8.0 kgf/cm$^2$ or more, the releasing work with the decorative mold being bent becomes easy. When the average particle diameter of the foamed particles, i.e., a raw material, constituting the present decorative mold is 1 to 4 mm, a fine uneven pattern can be formed easily and the pattern becomes highly precise. When the side walls of the mold are spread out from the undersurface side toward the surface where an uneven pattern is formed, the decorative molds can be arranged side by side without forming any clearances between the adjacent decorative molds, and as a result there is not such a fear that the appearance of the concrete surface is degraded by burrs due to the joint between the decorative molds.

When the present decorative mold has such a crystalline structure that the DSC curve obtained by subjecting the molded product of foamed particles that constitutes the decorative mold to differential scanning calorimetry has a high-temperature peak the amount of heat of which is 13 to 30 J/g on the side where the temperature is higher than that of the inherent peak corresponding to the absorption of heat at the time of melting of the polypropylene type resin, the heating and molding for obtaining the surface having an uneven pattern for transfer becomes easy and the rigidity of the molded product becomes favorable.

DETAILED DESCRIPTION OF THE PREFERRED EMBODIMENTS

Now an embodiment of the present invention will be described with reference to the drawings.

Figure 1:
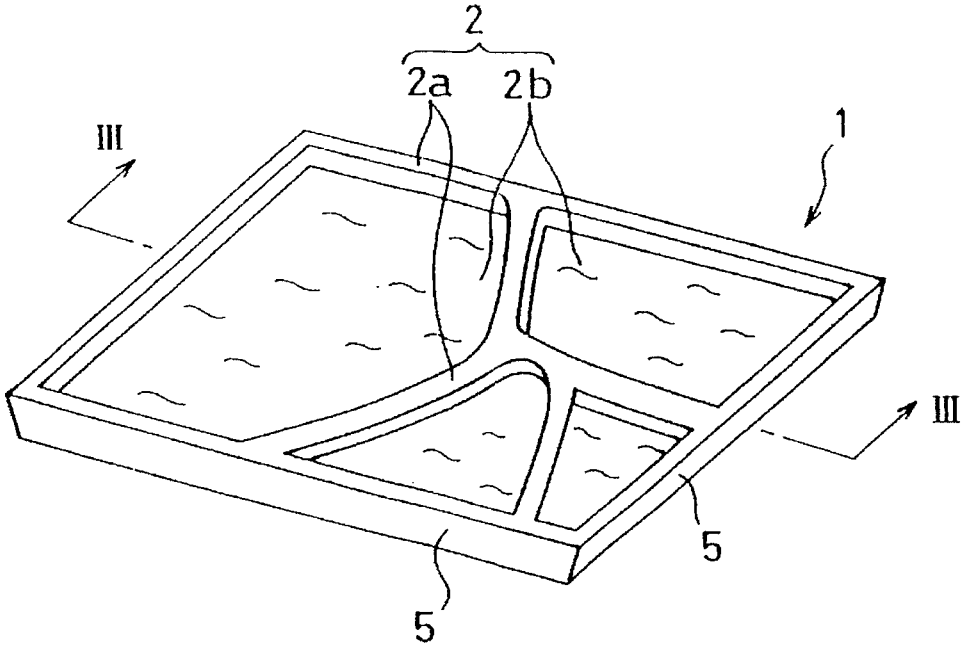
FIG. 1 is a perspective view showing an embodiment of the present decorative mold.

Referring to FIG. 1, as an embodiment of the present invention, is shown a decorative mold 1 for transferring a masonry pattern onto a concrete surface. One surface of the decorative mold 1 is formed with an uneven pattern 2 consisting of projected parts 2*a* for transferring and forming boundary parts of a masonry pattern and recessed parts 2*b* for transferring and forming individual stone patterns. Parenthetically, in the present invention, although the uneven pattern may be a pattern consisting of recessed parts with the bottom being flat for forming a brickwork and projected parts for forming masonry joints, preferably the uneven pattern has the irregular recessed parts 2*b* like a stonework because the surface area of the decorative mold is increased and the flexibility and the mechanical strength tend to increase.

The decorative mold 1 of the present invention comprises a molded product of polypropylene type resin foamed particles and has a density of 0.02 to 0.06 g/cm$^3$, preferably 0.03 to 0.06 g/cm$^3$, and more preferably 0.035 to 0.05 g/cm$^3$. If the density is less than 0.02 g/cm$^3$, since the decorative mold 1 is unsatisfactory in compressive strength, there is a fear that the decorative mold 1 cannot withstand the surface pressure of the placed concrete and may be deformed consequently and the transferability is also lowered. On the other hand, if the density is more than 0.06 g/cm$^3$, for example, since a number of voids are formed in the molded product of foamed particles, the releasability of the decorative mold 1 from the concrete surface becomes poor, and since the weight of the decorative mold 1 is increased, the transportation and the operability of the decorative mold 1 at the time of storage and execution become troublesome.

Although the present decorative mold 1 is obtained by molding foamed particles of a polypropylene type resin that is a raw material in a mold, if foamed particles of a polyethylene type resin or the like, such as foamed particles of a straight-chain low-density polyethylene, are used in place of the foamed particles of a polypropylene type resin, the resulting decorative mold 1 is defective in dimensional resistance. Further, since foamed particles of a low-density polyethylene are insufficient in material strength, to obtain a decorative mold with a prescribed strength, it is required to lower the expansion ratio, and as a result the weight of the decorative mold increases.

As the above polypropylene type resin, a propylene homopolymer and a copolymer of propylene with other copolymerizable monomer can be mentioned. As the monomer copolymerizable with propylene, for example, ethylene, 1-butene, pentene, hexene, and 4-methyl-pentene 1 can be mentioned. In the case of a copolymer, the content of the other monomer copolymerizable with propylene is preferably 20% by weight or less, and particularly 8% by weight or less. Further in the case of a copolymer, both a block copolymer and a random copolymer are acceptable and in addition to a bipolymer a terpolymer, such as an ethylene/propylene/butene copolymer, may be used. Although the polypropylene type resin foamed particles may be one that has been crosslinked, preferably the polypropylene type resin foamed particles are one that is not crosslinked in view of recyclability.

Figure 8:
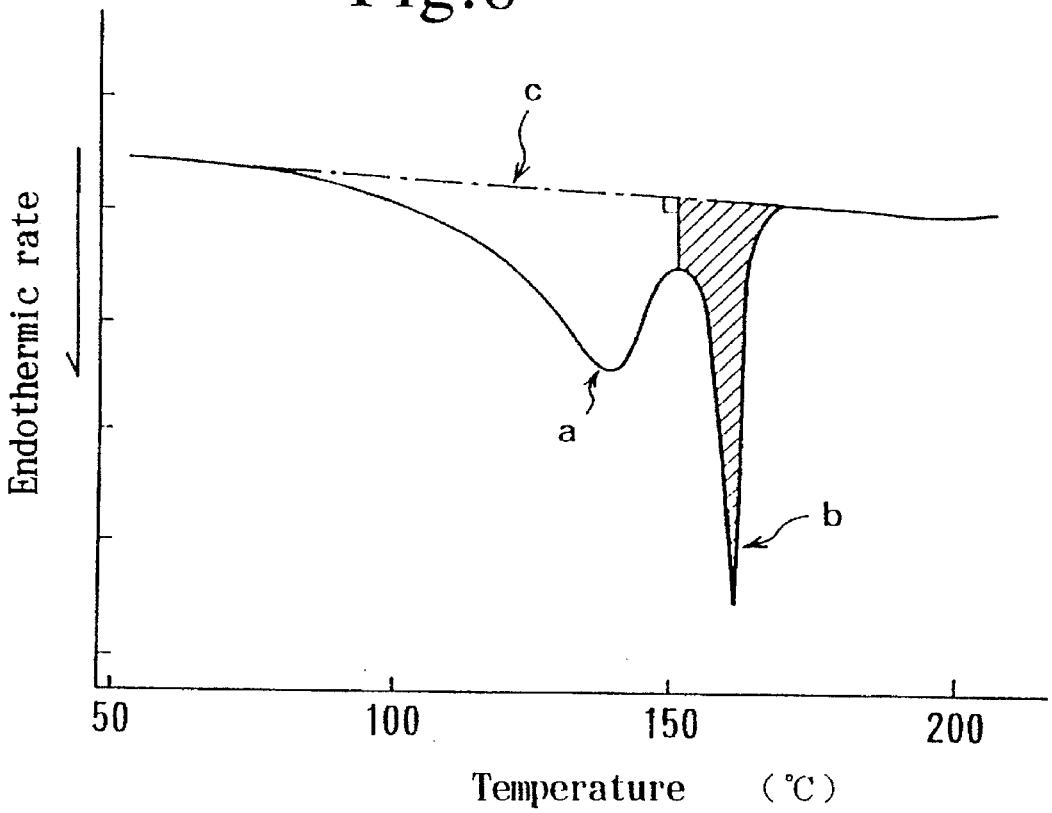
FIG. 8 is the DSC curve showing the crystalline structure with a high-temperature peak.

Preferably the polypropylene type resin foamed particles that are a raw material and will be loaded into a mold to produce the present decorative mold 1 have an average particle diameter of 1 to 4 mm, and particularly 2 to 3.5 mm. By heating and molding the foamed particles having such an average particle diameter in a mold, the surface of the obtained decorative mold 1 becomes excellent in smoothness and even if the uneven pattern 2 is fine, the uneven pattern 2 can be formed with high accuracy. Preferably, as shown in FIG. 8, the DSC curve obtained by differential scanning calorimetry of foamed particles used for the production or the molded product produced therefrom indicates a crystalline structure having, in addition to an inherent peak a corresponding to heat absorbed at the time when the polypropylene type resin is melted, a high-temperature peak b on the side where the temperature is higher than the side where the inherent peak a is present, and particularly preferably the amount of heat at the high-temperature peak b is 13 to 30 J/g, and more preferably 17 to 28 J/g.

As described above, the amount of heat at the high-temperature peak is set to be 13 to 30 J/g, and more preferably to be relatively higher, i.e., 17 to 28 J/g. This can suppress the shrinkage of the molded product of foamed particles as far as possible, makes easy the heating and molding operation for obtaining the surface having an uneven pattern for transfer that is characteristic of the present invention, and makes favorable the rigidity of the molded product. Parenthetically, the above DSC curve was obtained by heating 2 to 3 mg of foamed particles or a molded product obtained therefrom to 220° C. at a rate of 10° C./min and carrying out the measurement by a differential scanning calorimeter. The amount of heat at the high-temperature peak b corresponds to the area (shaded part in FIG. 8) surrounded by the curve of the high-temperature peak b and the base line c. Since the amount of heat at the high-temperature peak of foamed particles is scarcely changed by thermal history at the time of molding by a mold, the results of measurement of the foamed particle and those of a molded product made of that foamed particles by differential scanning calorimetry are identical.

Figure 2:
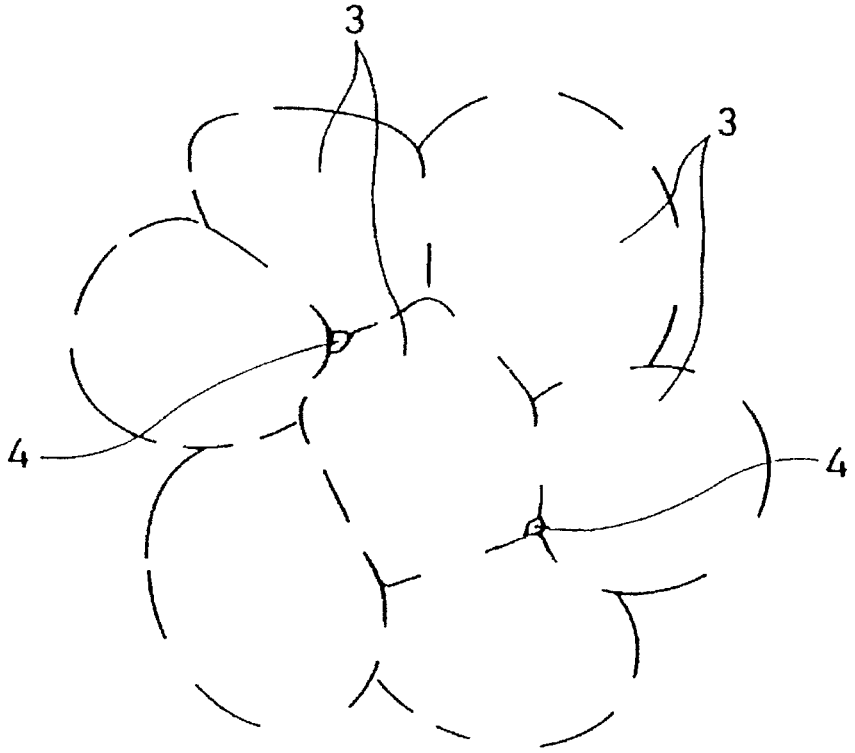
FIG. 2 is a rough sketch of the projected plane of the uneven patterned surface of the present decorative mold observed under a microscope.
Figure 7:
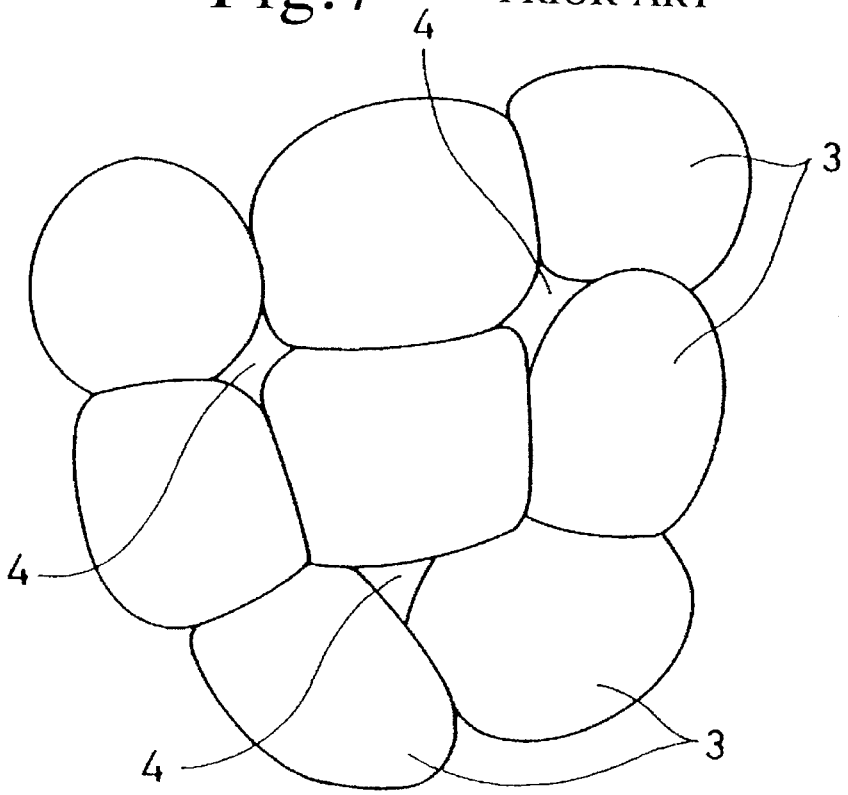
Fig.7 PRIOR ART
FIG. 7 is a rough sketch of the projected plane of the uneven patterned surface of a prior decorative mold observed under a microscope.

FIG. 2 shows the state of the surface of the present decorative mold 1 on which the uneven pattern 2 is formed and that is observed under an electron microscope, wherein 3 indicates foamed particles constituting the decorative mold 1, and 4 indicates gap sections. In the surface of the present decorative mold 1 on which the uneven pattern 2 is formed (the surface on the side where concrete will be placed), the ratio of gap sections 4 having an area of more than 0.075 $mm^2$ in terms of projected plane is very small in comparison with that of the prior art and the total area, in terms of projected plane, of the gap sections 4 present in all the projected plane of the decorative mold 1 accounts for less than 0.5%, and more preferably less than 0.3%, of the total area of the decorative mold 1 in terms of projected plane, whereas as shown in FIG. 7, in the prior molded product, large gap sections 4 having an area of more than 0.075 $mm^2$ in terms of projected plane are present in great numbers and when the ratio of the total area, in terms of projected plane, of the gap sections 4 is 0.5% or more, the adhesion between the decorative mold 1 and the coating material that is sprayed onto the decorative mold 1 and will be transferred to concrete becomes high to lower the transferability of the coating material and also marks made by the gap sections 4 formed on the concrete surface become conspicuous to degrade the appearance. More preferably, in the surface of the present decorative mold 1 where an uneven pattern is formed, there are no gap sections 4 having a projected area of more than 0.075 $mm^2$. The expression "a projected area of 0.075 $mm^2$" mentioned above does not refer to the size on an enlarged photograph but refers to the projected actual area of the voids present in the molded product.

The above-mentioned ratio of the total area, in terms of projected plane, of the gap sections 4 is found as follows. First, the surface having the uneven pattern 2 is photographed with the image enlarged 15 times by an electron microscope, the obtained photograph is enlarged 200% (in terms of area), then a 10 cm×10 cm square sheet of tracing paper having a certain weight per unit area is placed on the enlarged photograph, and all the gap sections 4 in the square are traced. Then, the weight of the tracing paper is weighed to 1/10,000 g, and all the traced gap sections are cut out by a cutter and are weighed to 1/10,000 g. From the weighed values, the ratio of the total area, in terms of projected plane, of the gap sections 4 is calculated according to the following formula:

$$A(\%)=\{(B-C)/B\}\times 100$$

wherein A represents the ratio (%) of the total area, in terms of projected plane, of the gap sections present in the surface with an uneven pattern for transfer to the total area of the projected plane of the decorative mold, B represents the weight (g) of the tracing paper, and C represents the weight (g) of the tracing paper from which all the gap sections traced on the tracing paper have been cut out.

The above operation is carried out at 5 places and the average value of the results is taken.

Further, preferably the present decorative mold 1 is such that the maximum bending strength of the decorative mold 1 determined by pressurizing the back surface opposite to the surface with an uneven pattern in accordance with JIS K7221 is 8.0 $kgf/cm^2$ or more, and more preferably 9 to 18 $kgf/cm^2$. The maximum bending strength of 8.0 $kgf/cm^2$ or more is due to the film formed by melting by the below-described method or the like on the surface where the uneven pattern 2 of the decorative mold 1 is present. Preferably the thickness of the film is 5 to 40 μm. In the case wherein such a film is formed, the fused boundaries between the foamed particles are scarcely noticed from the surface side, the flexibility of the surface is improved, and since the bending strength at the time when the decorative mold 1 is released from the concrete surface is increased, the durability of the decorative mold 1 is improved greatly. Further, in order to allow the decorative mold 1 to withstand the surface pressure of the placed concrete and to allow the transferability to be exhibited satisfactorily, preferably the compression strength at 5% compression determined in accordance with JIS K7220 is 0.5 $kgf/cm^2$ or more, and particularly preferably 1.0 to 2.0 $kgf/cm^2$.

Further, preferably the bending modulus determined in accordance with JIS K7221 is 65 to 150 $kgf/cm^2$, and particularly 85 to 120 $kgf/cm^2$, because in that case a suitable elasticity is exhibited to improve the working efficiency when the decorative mold 1 is released after the setting of the placed concrete.

These compression strength and bending modulus can be adjusted by the amount of heat at the above-described high-temperature peak or the below-mentioned internal pressure of the foamed particles to be loaded, the diameter of the foamed particles, the expansion ratio, the diameter or the shape of the cells constituting the foamed particles, or the like.

Figure 3:
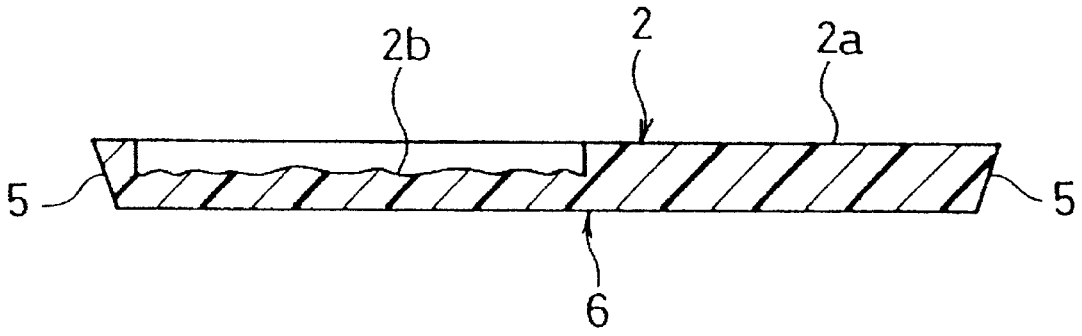
FIG. 3 is a vertical section taken along line III—III of FIG. 1.
Figure 6:
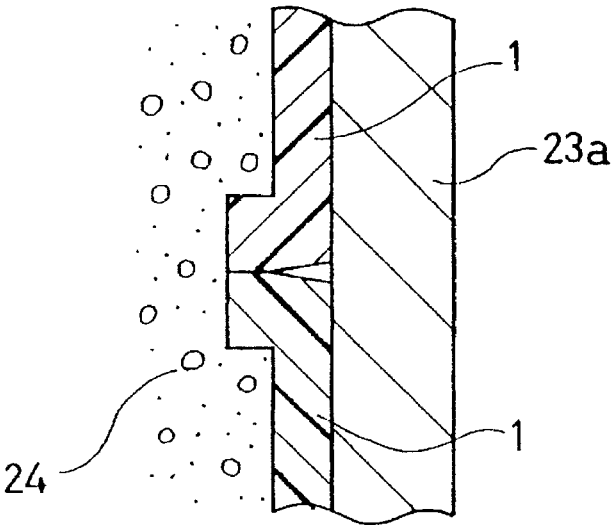
FIG. 6 is an enlarged view of a part A of FIG. 5.

As shown in FIG. 3, preferably the present decorative mold 1 has side walls 5 that are spread out from the side of an undersurface 6 to the side where the uneven pattern 2 is present. In order to cause the joined side walls to be pressed and deformed when a plurality of the present decorative molds 1 are joined, it is preferable that the side walls 5 of the decorative mold 1 are spread out as described above. In the case wherein the side walls 5 are spread out as described above, when the decorative molds 1 are arranged as shown in FIG. 6, since the connected parts of the adjacent decorative molds are readily pressed and deformed to come in close contact, the seam between the adjacent decorative molds is formed without any clearance and the concrete surface will not have a mark made with the seam between the adjacent decorative molds 1 as a burr. The present decorative mold 1 is generally a square plate but may be a polygonal plate, a circular plate, or an oblong plate depending on the usage.

Figure 4:
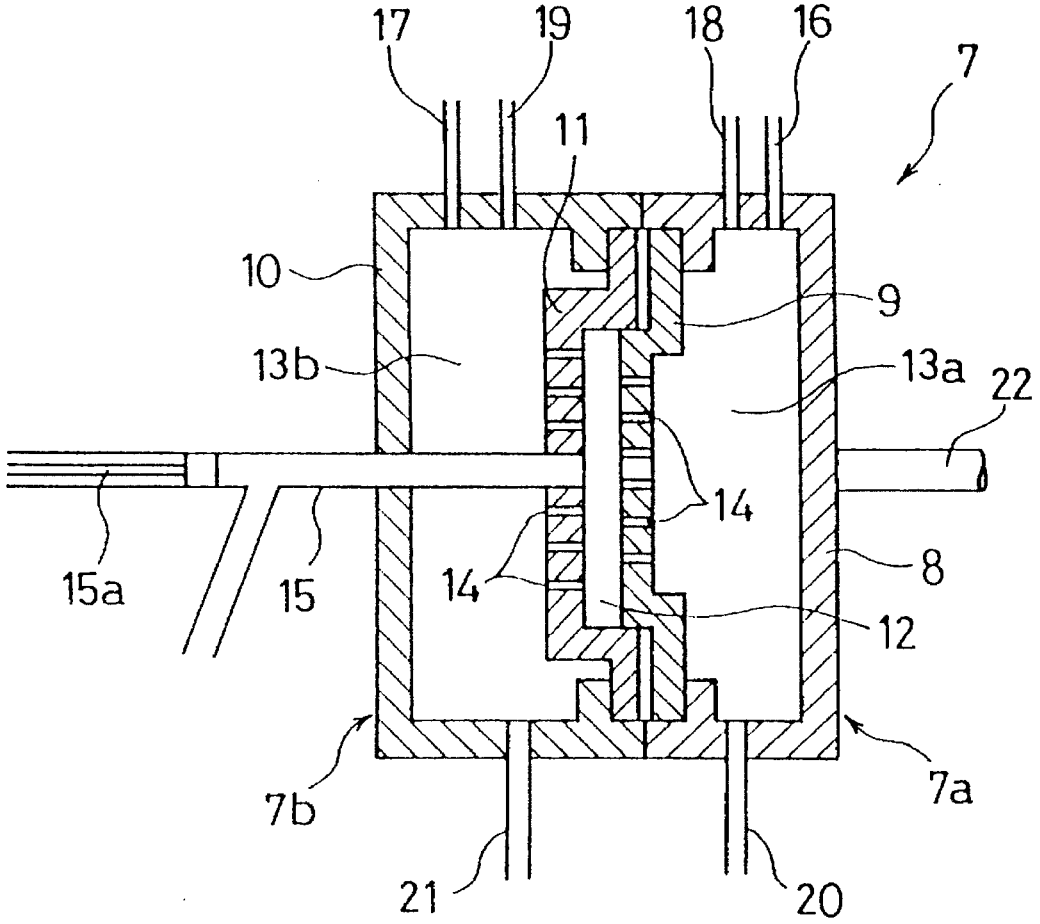
FIG. 4 is a rough sketch of a vertical section showing an embodiment of an apparatus for molding the present decorative mold.

To produce the present decorative mold 1, a mold 7 as shown in FIG. 4 is used. The mold 7 has a movable mold 7*a* and a stationary mold 7*b*, the movable mold 7*a* is composed of a movable frame 8 and a male mold 9 attached to the movable frame 8, and the stationary mold 7*b* is composed of a stationary frame 10 and a female mold 11 attached to the stationary frame 10. Each of the male mold 9 and the female mold 11 is formed with a plurality of steam holes 14 that are extended from a chamber 13*a* (or a chamber 13*b*) to a cavity 12 for heating foamed particles loaded into the cavity 12. The surface of the male mold 9 facing the cavity is formed with an uneven pattern corresponding to the uneven pattern 2 of the decorative mold 1. In FIG. 4, the reference numeral 15 indicates a foamed particle loader for loading foamed particles into the cavity 12, the reference numeral 15*a* indicates a piston of that loader, the reference numerals 16 and 17 indicate steam introduction pipes for heating, and the reference numerals 18, 19, 20, 21, and 22 indicate a cooling water introduction pipe, a cooling water introduction pipe, a drain pipe, a drain pipe, and a driving shaft of the movable mold 7*a*, respectively.

The present decorative mold 1 can be obtained by loading a raw material, i.e., polypropylene type resin foamed particles from the loader 15 into the cavity 12 of the mold 7, then introducing heating steam through the steam supply pipes 16 and 17 to heat the foamed particles, and molding the foamed particles; in order to obtain the decorative mold 1 wherein, in the surface having the uneven pattern 2, the ratio of the total area, in terms of projected plane, of the gap sections 4 is less than 0.5% as described above, for example, a method will be used wherein the side of foamed particles in the cavity 12 that faces the male mold 9 (i.e., the side where the uneven pattern 2 will be formed) is heated to a temperature equal to or higher than the melting point of the polypropylene type resin and that temperature is kept for a certain period. As the foamed particles to be loaded into the cavity 12, foamed particles having an internal pressure of 1.5 kg/cm$^2$ (G) or more, and more preferably 2.5 to 3.5 kg/cm$^2$ (G), can be used. In order to increase the compression strength of the present decorative mold 1, although a method is used wherein the amount of heat at the high-temperature peak described above is adjusted to increase the crystallinity of the polypropylene type resin, the higher the crystallinity is, the poorer the secondary expandability is, and therefore, in order to compensate it, a relatively higher internal pressure is given to the foamed particles. Further, in view of the smoothness and the mold duplicability of the uneven pattern for transfer of the decorative mold 1, preferably the average particle diameter of the foamed particles is adjusted to 1 to 4 mm; in the case of foamed particles having a relatively small particle diameter of 1 to 4 mm, the internal pressure drops quickly and therefore in order to prevent the internal pressure from dropping at the time when the foamed particles are transferred from a pressurizing tank to the mold, it is advantageous to give an internal pressure to the foamed particles as described above.

Now, a specific example of the production is shown below.

Production Example of the Decorative Mold

Polypropylene type resin foamed particles having an internal pressure of 2.8 kg/cm$^2$ (G) are loaded into the cavity 12, and after steam of 1 kg/cm$^2$ (G) is introduced for 5 sec into the chamber 13*a* on the side of the movable mold 7*a* and into the chamber 13*b* on the side of the stationary mold 7*b* through the heating steam supply pipes 16 and 17 to remove air present among the foamed particles in the cavity 12, steam is introduced through the steam supply pipe 17 into the chamber 13*b* on the side of the stationary mold 7*b* with both the drain pipe 21 on the side of the stationary mold 7*b* and the drain pipe 20 on the side of the movable mold 7*a* closed until the pressure in the chamber 13*b* reaches 2.0 kg/cm$^2$ (G). Then steam is introduced into the chamber 13*a* on the side of the movable mold 7*a* through the steam supply pipe 16 until the pressure in the chamber 13*a* reaches 3.8 kg/cm$^2$ (G), and that pressure is kept for 5 sec. Thereafter, the drain pipe 20 on the side of the movable mold 7*a* and the drain pipe 21 on the side of the stationary mold 7*b* are opened and after cooling water is introduced into the chambers 13*a* and 13*b* through the cooling water introduction pipes 18 and 19, the movable mold 7*a* is retracted to open the mold 7, and the decorative mold 1 is taken out. In the above step, instead of the technique wherein the pressure in the chamber 13*a* is kept at 3.8 kg/cm$^2$ (G) for 5 sec, a method can be used wherein steam is supplied into the chamber 13*a* on the side of the movable mold 7*a* until the pressure in the chamber 13*a* reaches 4.2 kg/cm$^2$ (G) and thereafter the pressure in the chamber 13*a* is gradually reduced to 2.5 kg/cm$^2$ (G) over 15 sec.

In order to obtain a decorative mold 1 for forming a beautiful uneven pattern on a concrete wall surface by transfer using the mold 7, preferably the surface of the male mold 9 on the side of the cavity 12 for molding the surface of the decorative mold 1 where an uneven pattern 2 will be formed is provided with a fluorine coating, and preferably the steam holes 14 that are provided at least in the male mold 9 are conical in shape rather than slit in shape as in the case of steam holes of ordinary molds. Further, preferably, the male mold 9 can form a grain pattern on the surface part of the projected parts 2*a* of the decorative mold 1 and when such a decorative mold 1 is used, the stonework pattern part and the joint pattern part transferred onto the concrete wall surface are contrasted, which is preferable because natural feeling is created.

Further, preferably, the molding is carried out in such a manner that the piston 15*a* of the foamed particle loader 15 and the forward end of an ejection pin (not shown) or the like for removing the molded product from the mold are projected into the cavity 12. Although in the ordinary molding the marks made by the piston and the ejection pin become projected parts on the molded product, in the above case, the marks formed on the undersurface 6 of the obtained decorative mold 1 by the piston 15*a* of the loader 15 and the ejection pin become recessed parts, and therefore when the the undersurface 6 of the decorative mold 1 is attached to a concrete placement support, the decorative mold 1 can be attached stably since no projected parts are formed. Additionally stating, in the present decorative mold 1, it is naturally preferable that the surface opposite to the surface having the uneven pattern is flat because that surface will be attached to a concrete placement support.

In the above manner, a decorative mold 1 can be obtained wherein the ratio of the total area, in terms of projected plane, of the gap sections 4 on the side of the surface where the uneven pattern 2 is formed is less than 0.5%. Preferably, the maximum bending strength of the decorative mold 1 determined by pressurizing the back of the surface having the uneven pattern is adjusted to 8.0 kgf/cm$^2$ or more and it is considered that such a physical property is due to the formation of a film made by melting on the surface having the uneven pattern.

Figure 5:
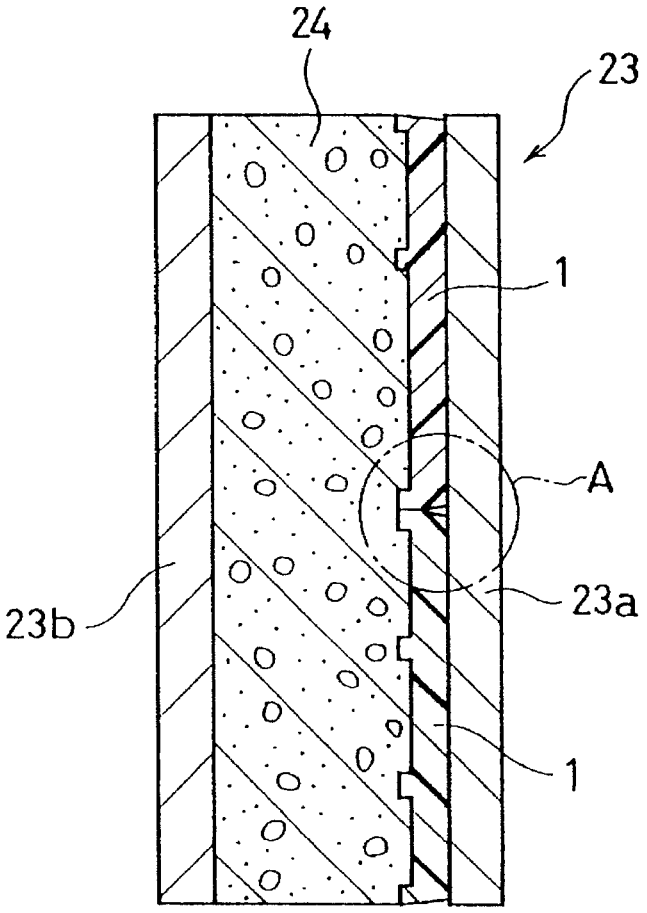
FIG. 5 is a vertical section showing a step of forming a concrete surface with an uneven pattern.

Now, the method of forming a concrete surface having an uneven pattern by using the present decorative mold 1 will be described. Although, like the ordinary concrete placement method, in the present method also, as shown in FIG. 5, concrete placement supports 23*a* and 23*b* are opposed to make a form 23 and concrete 24 will be placed in the gap part of the form 23, in the present method, the concrete placement form 23 is made such that the present decorative mold 1 is attached to at least one of the concrete placement supports 23*a* and 23*b* with the uneven pattern 2 of the decorative mold 1 facing the side where the concrete will be placed. Parenthetically, the surface of the decorative mold 1 where the uneven pattern 2 is formed may be coated previously with a coating material by spraying or the like to make the concrete surface colored. Then the concrete 24 is placed in the gap part of the concrete placement form 23. After the concrete 24 is set, first the supports 23*a* and 23*b* are disassembled and then the decorative mold 1 is released from the concrete surface 24, in which the release is carried out while the decorative mold 1 is being bent.

In comparison with the prior decorative mold, since the present decorative mold 1 is excellent in flexibility, there is no fear that the decorative mold 1 is damaged when the decorative mold 1 when released is bent, and the decorative mold 1 can be readily released by removing the decorative mold 1 while bending the decorative mold 1, making the release work of the decorative mold 1 quite easy.

Now the present invention will be described in more detail with reference to the following specific Example.

EXAMPLE 1

Ethylene/propylene random copolymer foamed particles (melting point: 145° C.; average particle diameter: 3 mm; ethylene component content: 2.3% by weight; particle internal pressure: 2.8 kg/cm$^2$ (G); bulk density: 0.045 g/cm$^3$; and amount of heat of the high-temperature peak: 25 J/g) were loaded into the cavity of the mold having the male mold with the uneven pattern, polypropylene type resin foamed particles having an internal pressure of 2.8 kg/cm$^2$ (G) were loaded into the cavity 12 in the manner as shown in the above Production Example, steam of 1 kg/cm$^2$ (G) was introduced into the chamber 13*a* on the side of the movable mold 7*a* and the chamber 13*b* on the side of the stationary mold 7*b* for 5 sec through the heating steam supply pipes 16 and 17 to remove air present among the foamed particles in the cavity 12, and then steam was introduced into the chamber 13*b* on the side of the stationary mold 7*b* through the steam supply pipe 17 with both the drain pipe 21 on the side of the stationary mold 7*b* and the drain pipe 20 on the side of the movable mold 7*a* closed until the pressure in the chamber 13*b* reached 2.0 kg/cm$^2$ (G). Then, the supply of steam into the chamber 13*a* on the side of the movable mold 7*a* was effected until the pressure in the chamber 13*a* reached 4.2 kg/cm$^2$ (G), thereafter the pressure in the chamber 13*a* was gradually reduced to 2.5 kg/cm$^2$ (G) over 15 sec, and then after the drain pipe 20 on the side of the movable mold 7*a* and the drain pipe 21 on the side of the stationary mold 7*b* were opened, cooling water was introduced into the chambers 13*a* and 13*b* through the cooling water introduction pipes 18 and 19, the movable mold 7*a* was retracted to open the mold 7, and the thus molded decorative mold 1 was taken out. The density of the obtained decorative mold, the smoothness of the surface of the decorative mold that has an uneven pattern, and the result of the bending strength test are shown in Table 1.

The obtained decorative molds were arranged in rows and columns on the surface of a concrete placement support with the surface having the uneven pattern outward and were temporarily stuck, and the concrete placement support having the decorative molds temporarily stuck and a concrete placement support having no decorative molds were arranged with the surface of the concrete placement support having the decorative molds opposite to the other concrete placement support so as to make a concrete placement form. Then, concrete was placed in the gap part of the form, and after setting the concrete, the supports were disassembled, and the decorative molds were released from the concrete surface while the decorative molds being bent, so that a concrete surface having uneven patterns transferred thereto from the decorative molds was formed.

The results of the evaluation of the transferability of the uneven pattern onto the concrete wall surface, the releasability of the decorative mold, and the durability of the decorative mold are also shown in Table 1. Additionally stating, the smoothness of the surface of the decorative mold where the uneven pattern was formed, the bending strength, the transferability of the uneven pattern, and the releasability and the durability of the decorative mold were evaluated based on the following criteria. Incidentally, in the surface of the decorative mold obtained in Example 1 that had an uneven pattern, there were no gap sections having a projected area of more than 0.075 mm$^2$, and the decorative mold had a bending modulus of 97 kgf/cm$^2$ and a compression strength of 1.6 kgf/cm$^2$. With respect to the decorative molds composed of a molded product of foamed particles that were obtained in Example 1 and Comparative Examples 1 and 2, the amount of heat of the high-temperature peak of the DSC curve of each of the molded products measured by differential scanning calorimetry was 25 J/g.

(1) Smoothness

The surface of the decorative mold where an uneven pattern was formed was photographed with the image enlarged 15 times under an electron microscope and from the obtained photographs, the ratio of the total area, in terms of projected plane, of the gap sections was found by the above-described method. The photographs were taken at 5 arbitrary different positions and the average value of the results was taken to evaluate as follows:

○: The ratio of the total area, in terms of projected plane, of the gap sections was less than 0.5%.

Δ: The ratio of the total area, in terms of projected plane, of the gap sections was 0.5% to 0.7%.

X: The ratio of the total area, in terms of projected plane, of the gap sections was over 0.7%.

(2) Maximum bending strength

In accordance with JIS K7221, a test specimen was cut out from the surface of the decorative mold that had an uneven pattern so that the distance between the supports, the width, and the thickness might be 100 mm, 25 mm, and 25 mm, respectively (provided that the test specimen had the central part between the supports as flat as possible and in the case of a thick decorative mold, it is sliced to have a thickness of about 25 mm with the surface having the uneven pattern remained.). A pressure wedge whose tip has a radius of 5 mm was pressed to the center of the test specimen from the undersurface at a rate of 10 mm/min until the test specimen showed the maximum load on the output chart, and the maximum bending strength was calculated on the basis of the load.

(3) Transferability

The duplicability of the uneven pattern onto the concrete surface and the presence or absence of defects of the pattern due to air bubbles or the like were observed and the evaluation was made as follows:

○: The pattern was duplicated faithfully.

Δ: Although the pattern was duplicated, there are unclear parts at fine sections.

X: The pattern was not duplicated faithfully due to air bubbles or the like.

(4) Releasability

The surface of the decorative mold that had an uneven pattern was sprayed with an inorganic coating material, concrete was placed using that decorative mold, and after the decorative mold was released, the surface of the decorative mold that had an uneven pattern was observed and the evaluation was made as follows:

○: There was no remainder of the coating material on the surface of the decorative mold.

Δ: Some remainder of the coating material was observed on the surface of the decorative mold.

X: It was observed that the coating material remained over a wide range of the surface of the decorative mold.

(5) Durability

The decorative mold was released with one end of the decorative mold picked up to bend the decorative mold, the surface of the decorative mold that had an uneven pattern was observed after the release, and the evaluation was made as follows:

○: Any damage or cracks were not observed on the surface.

X: Damage and/or cracks were observed on the surface.

TABLE 1

| | Example 1 | Comparative Example 1 | Comparative Example 2 |
|---|---|---|---|
| Density of decorative mold (g/cm$^3$) | 0.045 | 0.045 | 0.045 |
| Smoothness | ○ | X | X |
| Maximum bending strength (kgf/cm$^2$) | 11.7 | 5.2 | 6.9 |
| Execution test | | | |
| Transferability | ○ | Δ | Δ |
| Releasability | ○ | Δ | Δ |
| Durability | ○ | X | ○ |

Comparative Example 1

Example 1 was repeated for molding, except that after the same foamed particles as those used in Example 1 were loaded into the mold, the pressure of the steam supplied from the movable mold side was changed from 4.2 kg/cm$^2$ (G) to 3.2 kg/cm$^2$ (G). The smoothness of the surface of the obtained decorative mold where an uneven pattern was formed and the bending strength are shown in Table 1. Using the decorative molds, a concrete surface having an uneven pattern was made and the transferability of the uneven pattern, and the releasability and the durability of the mold were evaluated, the results being also shown in Table 1.

Comparative Example 2

Example 1 was repeated for molding, except that after the same foamed particles as used in Example 1 were loaded into the mold, steam was supplied from the movable mold side to bring the pressure to 4.2 kg/cm$^2$ (G) and then cooling was carried out immediately. The smoothness of the surface of the obtained decorative mold where an uneven pattern was formed and the bending strength are shown in Table 1. Using the decorative molds, a concrete surface having an uneven pattern was made and the transferability of the uneven pattern, and the releasability and the durability of the mold were evaluated, the results being also shown in Table 1.

What is claimed is:

1. A decorative mold for forming an uneven pattern on a concrete surface by transfer, comprising a molded product of polypropylene resin foamed particles that has a density of 0.02 to 0.06 g/cm$^3$ and possesses on one surface an uneven pattern for forming an uneven pattern on a concrete surface by transfer, wherein, in the surface having the uneven pattern for transfer, the total area, in terms of projected plane, of gap sections present in all the projected plane of the decorative mold accounts for less than 0.5% of all the area, in terms of projected plane, of the decorative mold, and wherein said polypropylene resin is selected from the group consisting of a propylene homopolymer or a copolymer of propylene with other copolymerizable monomer.

2. The decorative mold as claimed in claim 1, wherein in said copolymer of propylene with other copolymerizable monomer, said copolymerizable monomer is selected from the group consisting of ethylene, 1-butene, pentene, hexene or 4-methyl-pentene-1.

3. The decorative mold as claimed in claim 1, wherein in said copolymer of propylene with other copolymerizable monomer, said copolymerizable monomer comprises 20% by weight or less of said copolymer.

4. The decorative mold as claimed in claim 3, wherein in said copolymer of propylene with other copolymerizable monomer, said copolymerizable monomer comprises 8% by weight or less of said copolymer.

5. The decorative mold as claimed in claim 1, wherein said copolymer of propylene with other copolymerizable monomer is a random copolymer.

6. The decorative mold as claimed in claim 1, wherein said copolymer of propylene with other copolymerizable monomer is a block copolymer.

7. The decorative mold as claimed in claim 1, wherein the maximum bending strength of the decorative mold determined by pressing from the undersurface opposite to the side having the uneven pattern in accordance with JIS K7221 is 8.0 kgf/cm$^2$ or more.

8. The decorative mold as claimed in claim 1 or claim 7, wherein the average particle diameter of the polypropylene resin foamed particles that are a raw material constituting the decorative mold is 1 to 4 mm.

9. The decorative mold as claimed in claim 1, wherein the side walls are spread out from the undersurface side of the decorative mold toward the side of the surface having the uneven pattern.

10. The decorative mold as claimed in claim 1, wherein the molded product of polypropylene resin foamed particles that constitutes the decorative mold has such a crystalline structure that the DSC curve obtained by subjecting the molded product to differential scanning calorimetry has, in addition to the inherent peak corresponding to the absorption of heat at the time of melting of the polypropylene resin, a high-temperature peak the amount of heat of which is 13 to 30 J/g on the side where the temperature is higher than that of said inherent peak.

* * * * *